US005083449A

United States Patent [19]

Kobayashi et al.

[11] Patent Number: 5,083,449

[45] Date of Patent: Jan. 28, 1992

[54] METHOD OF REDRAWING FLANGED CUP

[75] Inventors: Tomomi Kobayashi; Katsuhiro Imazu, both of Yokohama, Japan

[73] Assignee: Toyo Seikan Kaisha, Ltd., Tokyo, Japan

[21] Appl. No.: 611,604

[22] Filed: Nov. 13, 1990

[30] Foreign Application Priority Data

Nov. 13, 1989 [JP] Japan ..... 1-292456

[51] Int. Cl.[5] ..... B21D 22/20

[52] U.S. Cl. ..... 72/349; 72/379.4

[58] Field of Search ..... 72/347, 348, 349, 379.4

[56] References Cited

U.S. PATENT DOCUMENTS 4,962,659 10/1990 Imazu et al. ..... 72/349

FOREIGN PATENT DOCUMENTS 2103134 2/1983 United Kingdom ..... 72/349

*Primary Examiner*—Lowell A. Larson

*Attorney, Agent, or Firm*—Sughrue, Mion, Zinn Macpeak & Seas

[57] ABSTRACT

Disclosed is a redrawing method in which a preliminarily drawn cup having a flange is engaged with a flange-correcting die arranged coaxially with a blank holder to surround the blank holder with a small distance from the peripheral face of the blank holder before the residual flange of the preliminarily drawn cup is introduced into a clearance between the blank holder and a redrawing die, and the preliminarily drawn cup is redrawn in this state. The flange-correcting die has a working face, the inner diameter of which is gradually decreased, and the distance of from the peripheral face of the cup on the tangential line of the working face to the point of the contact with the working face is substantially constant at least in the introduction side portion of the working face. According to this redrawing method, a draw-redraw-formed can having an excellent shape or dimensional precision can be obtained without occurrence of troubles such as edge breaking of the material, breaking of the coating and formation of an enamel hair.

4 Claims, 8 Drawing Sheets

PUNCHING STEP

DRAWING STEP

FIRST REDRAWING STEP n-th REDRAWING STEP

PUNCHING STEP

DRAWING STEP

FIRST REDRAWING STEP n-th REDRAWING STEP

METHOD OF REDRAWING FLANGED CUP

BACKGROUND OF THE INVENTION

1. Field of the Invention

The present invention relates to a method of redrawing a flanged cup. More particularly, the present invention relates to a method of stably producing a draw-redraw-formed can having an excellent dimensional or shape precision, in which the forming load imposed at the redrawing step can be reduced, and troubles caused by an excessive forming load, such as edge breaking, breaking of the coating and formation of a waste thread (enamel hair), are eliminated.

2. Description of the Related Art

In the field of the can-manufacturing industry, the preparation of a seamless can barrel having a large can height by subjecting a metal sheet, especially a coated metal sheet, to draw-redraw forming has been worked from old.

The preparation of this draw-redraw-formed can is performed according to the process comprising holding a preliminarily drawn cup by an annular blank holder (cup-holding member) inserted into the cup and a redrawing die, relatively moving the redrawing die and a redrawing punch arranged coaxially with the blank holder and redrawing die and movably within the blank holder so that the redrawing punch and the redrawing die are engaged with each other, and draw-forming the cup into a deep-draw-formed cup having a diameter smaller than that of the preliminarily drawn cup. Furthermore, there has already been known a process in which at the redrawing step, by using a redrawing die having a sufficiently small radius of curvature and sufficiently increasing the back tension applied by combination of the blank holder and redrawing die, the thickness of the side wall portion of the final cup is reduced by bending elongation (see Japanese Unexamined Patent Publication No. 01-258822).

In draw forming of a metal sheet, in general, in order to perform draw forming completely under a certain blank-holding force-acting condition, prevent formation of wrinkles in the formed cup and obtain a can having an excellent shape or dimensional precision, it is important that draw forming should be carried out so that a flange is left in the formed cup.

However, in the case where a preliminarily drawn cup is redraw-formed into a cup having a smaller diameter, it is necessary that the flange left in the preliminarily drawn cup should be pulled into the blank-holding surface between the blank holder and the redrawing die, and therefore, the forming load is drastically increased at this point. By this increase of the forming load, edge breaking of the material, breaking of the coating and formation of a waste yarn (enamel hair) are caused, resulting in reduction of the yield of cans or the productivity. Furthermore, in the final can barrel, the portion corresponding to the flange of the preliminarily drawn cup is poor in the shape-manifesting property as compared with other portions, and the dimensional precision is often degraded in this portion. Moreover, it has been confirmed that in the portion through which this residual flange passes, a tool or the like is readily damaged.

SUMMARY OF THE INVENTION

It is therefore a primary object of the present invention to overcome the above-mentioned defects of the conventional draw-redraw forming method and provide a method of redrawing a flanged cup, in which the forming load applied at the step of draw-forming a residual flange of a preliminarily drawn cup can be reduced, edge breaking of the blank, breaking of the coating and formation of a waste thread can be prevented, and a draw-redraw-formed can having an excellent shape or dimensional precision can be provided.

In accordance with the present invention, there is provided a redrawing method comprising holding a preliminarily drawn cup by an annular blank holder inserted in the cup and a redrawing die, relatively moving the redrawing die and a redrawing punch arranged coaxially with the blank holder and the redrawing die and movably within the blank holder so that the redrawing die and redrawing punch are engaged with each other, and draw-forming the preliminarily drawn cup into a deep-draw-forming cup having a diameter smaller than that of the preliminarily drawn cup, wherein the cup which has been preliminarily draw-formed so that a flange is left is engaged with a flange-correcting die which is arranged coaxially with the blank holder to surround the blank holder with a small distance from the peripheral face of the blank holder, before the residual flange of the cup is introduced into a clearance between the blank holder and the redrawing die, and the flange-correcting die has a working face, the inner diameter of which is gradually decreased from the introduction side, and the distance (PQ) of from the peripheral face of the cup on the tangential line of said working face to the point of contact with the working face is substantially constant at least in the introduction side portion of the working face, whereby the residual flange is corrected and formed into an extension of the side wall face of the preliminarily drawn cup.

By the preliminarily drawn cup referred to herein is meant a cup obtained by draw forming conducted before redraw forming, or a cup obtained at a preceding step in the multi-staged redraw forming.

By the preliminary drawing is meant a drawing operation conducted before redraw forming, or a drawing operation conducted at a precedent step in the multi-staged redraw forming.

Preferably, the flange-correcting die has a working face having a shape of a tractrix or a shape akin thereto.

It is preferred that the distance (PQ) be almost equal to the width of the residual flange.

The present invention is especially valuably applied to the redrawing process in which the side wall of a cup is engaged with a corner-portion of the redrawing die and the thickness of the side wall is reduced by bending elongation.

According to the present invention, it is important that a flange should be left in the preliminarily drawn cup. If this requirement is satisfied, the preliminary draw forming is carried out under a constant blank-holding force-applied condition and formation of wrinkles in the formed cup is prevented, and furthermore, the shape-manifesting property and dimensional precision of the preliminarily cup are improved. It must be noted that if there are defects in the preliminarily drawn cup, it is difficult to correct these defects at the subsequent redraw forming.

According to the present invention, a cup which has been preliminarily drawn so that a flange is left is engaged with a flange-correcting die arranged coaxially with the blank holder to surround the peripheral face of the blank holder with a small distance therefrom before the residual flange is introduced in a clearance between the blank holder and the redrawing die. The flange-correcting die used has a working face, the inner diameter of which is gradually decreased from the introduction side, and the distance of from the peripheral face of the cup on the tangential line of this working face to the point of the contact with the working face is substantially constant at least in the introduction side portion of the working face.

If a flange-correcting die having the above-mentioned working face is used, since the residual flange is always brought in contact with the working face vertically at the point of the contact with the working face, the flexural moment to the residual flange is effectively transmitted and the residual flange is formed into an extension of the side wall face of the preliminarily drawn cup, with the result that the forming load necessary for forming can be reduced. Furthermore, since the distance (PQ) between the peripheral face of the cup on the tangential line of the working face and the point of the contact to which the working face is constant, the position to which the flange-correcting force (flexural moment) is applied is set at the same position, and therefore, the flange-correcting operation can be performed stably and smoothly. This is another advantage attained according to the present invention.

In the present invention, since the position of the flange-correcting force applied to the flange from the working face of the flange-correcting die is always constant, it is possible to regulate the position of application of the flange-correcting force on the outermost line of the residual flange (namely, the distance (PQ) can be made almost equal to the width of the residual flange), whereby the forming load necessary for correcting the flange can be controlled to a minimum level.

According to the present invention, by such a small forming load, the residual flange can be corrected and formed into an extension of the side wall face of the preliminarily drawn cup in advance, and by supplying the preliminarily drawn cup in this state into the blank holding face between the blank holder and the redrawing die, edge breaking of the material, breaking of the coating and formation of a waste thread (enamel hair) can be prevented and a draw-redraw-formed can having excellent shape-manifesting property and dimensional precision can be stably prepared with a good productivity. Moreover, damage or wear of a tool or the like can be controlled.

BRIEF DESCRIPTION OF THE DRAWINGS

FIGS. 1 through 3 are diagrams illustrating the redrawing method of the present invention, in which FIG. 1 shows the state before the start of redrawing, FIG. 2 show the state during redrawing and FIG. 3 shows the state during flange-correcting forming.

DETAILED DESCRIPTION OF THE PREFERRED EMBODIMENTS

Figure 1:
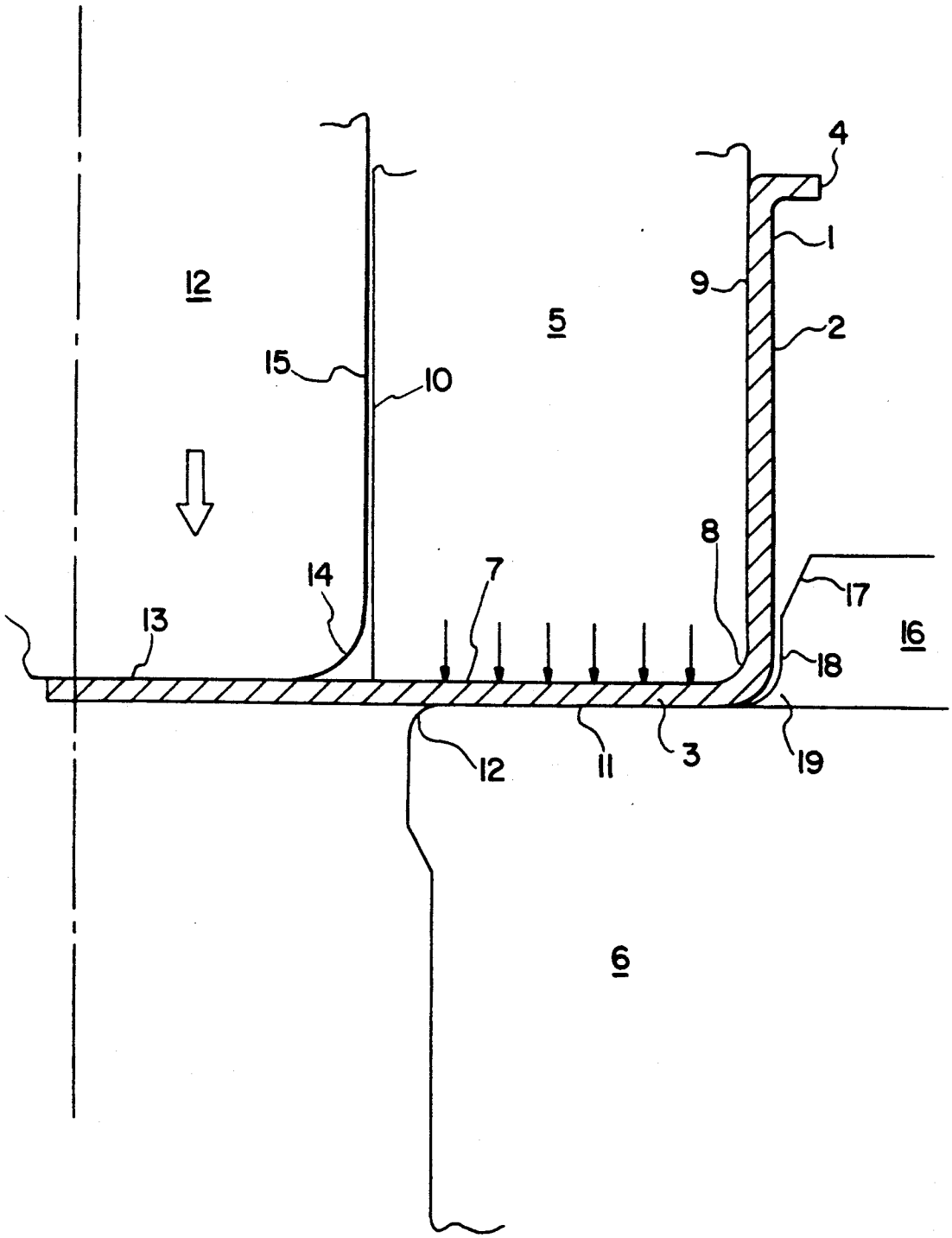

Referring to FIGS. 1 (before the start of redrawing), 2 (during redrawing) and 3 (during flange-correcting forming) illustrating the redrawing method of the present invention, a preliminarily drawn cup 1 formed of a coated metal sheet comprises a side wall 2, a bottom wall 3 and a residual flange 4 contiguous to the top end of the side wall.

The preliminarily drawn cup 1 is held by an annular blank holder 5 inserted in the cup and a redrawing die 6 located below the blank holder. More specifically, the annular blank holder 5 has a bottom 7 abutting to the bottom wall 3 of the cup, a corner portion 8, a peripheral portion 9 engaged loosely with the side wall 2 of the cup and an inner circumferential portion 10, and the redrawing die 6 has a flat portion 11 and a working corner portion 12 for redrawing and the bottom 3 of the cup is held between the bottom 7 of the blank holder and the flat portion 11 of the redrawing die.

A redrawing punch 12 is arranged coaxially with the blank holder 5 and redrawing die 6 on the inner side of the inner circumferential portion 10 of the blank holder so that the redrawing punch 12 can move within the blank holder 5. The redrawing punch 12 comprises a bottom 13, a corner portion 14 and a peripheral portion 15 having a diameter smaller than that of the inner circumferential portion of the blank holder.

According to the present invention, a flange-correcting die 16 is arranged above the flat portion 11 of the redrawing die outwardly of the peripheral portion 9 of the blank holder. This flange-correcting die 16 is disposed coaxially with the blank holder and separately from the peripheral face 9 of the blank holder by a small distance, that is, a distance slightly larger than the thickness of the side wall 2 of the preliminarily drawn cup. This correcting die 16 has a working face 17, the inner diameter of which is gradually decreased from the introduction side, and this working face 17 is formed so that the distance (PQ) of from the peripheral face of the cup on the tangential line of the working face to the point of the contact with the working face is substantially constant. A straight die face 18 may be connected to the working face 17 sot hat the die face 18 extends below the working face 17. In the embodiment illustrated in FIG. 1, a guiding corner portion 19 is formed between the straight die face 18 and the flat portion 11 of the redrawing die to smoothly guide an angular projection formed at drawing to the flat portion 11 of the redrawing die.

Figure 4:
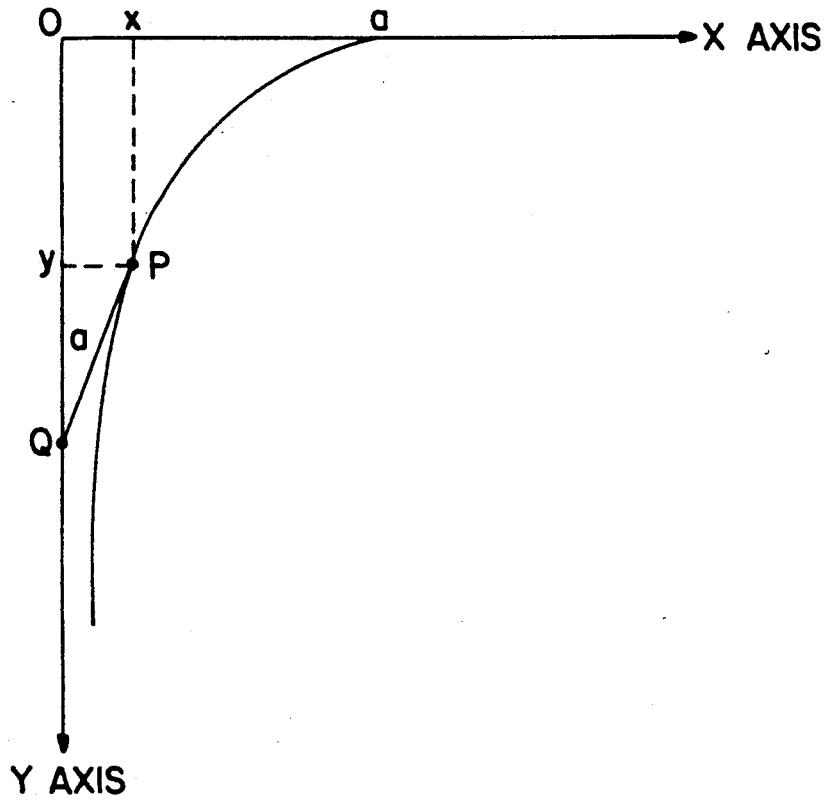
FIG. 4 is a diagram illustrating the shape of the working face of the flange-correcting die used in the present invention.

Referring to FIG. 4 illustrating the shape of the working face 17 of the flange-correcting die 16, the X axis of this graph represents the top end face (the end face on the introduction side) of the flange-correcting die and the X axis represents the peripheral face of the preliminarily drawn cup 1. The coordinate value x represents the distance from the peripheral face of the preliminarily drawn cup in the horizontal direction and the coordinate value y represents the distance from the introduction face in the vertical direction. When a tangential line is drawn to the working face 17 satisfying the requirements of the present invention, the following relation is established between the contact point P of this tangential line and the working face and the intersection point Q of this tangential line and the Y axis:

$$\overline{PQ}=a(\text{contact}) \quad (1)$$

The curve always satisfying the requirement of the above formula (1) satisfies the requirement of the following formula:

$$-\frac{dy}{dx}=\frac{\sqrt{a^2-x^2}}{x} \quad (2)$$

and hence, satisfies the following requirement:

$$y=a\cdot\ln\left(\frac{a+\sqrt{a^2-x^2}}{x}\right)-\sqrt{a^2-x^2} \quad (3)$$

This curve is known as a tractrix.

Ideally, the working face 17 of the flange-correcting die 16 has a shape of a tractrix as mentioned above. However, the working face may have a shape akin to the tractrix shape, for example, a similar shape defined by connecting a plurality of R's differing in the curvature or a similar shape defined by connecting these R's through tapers.

Figure 2:
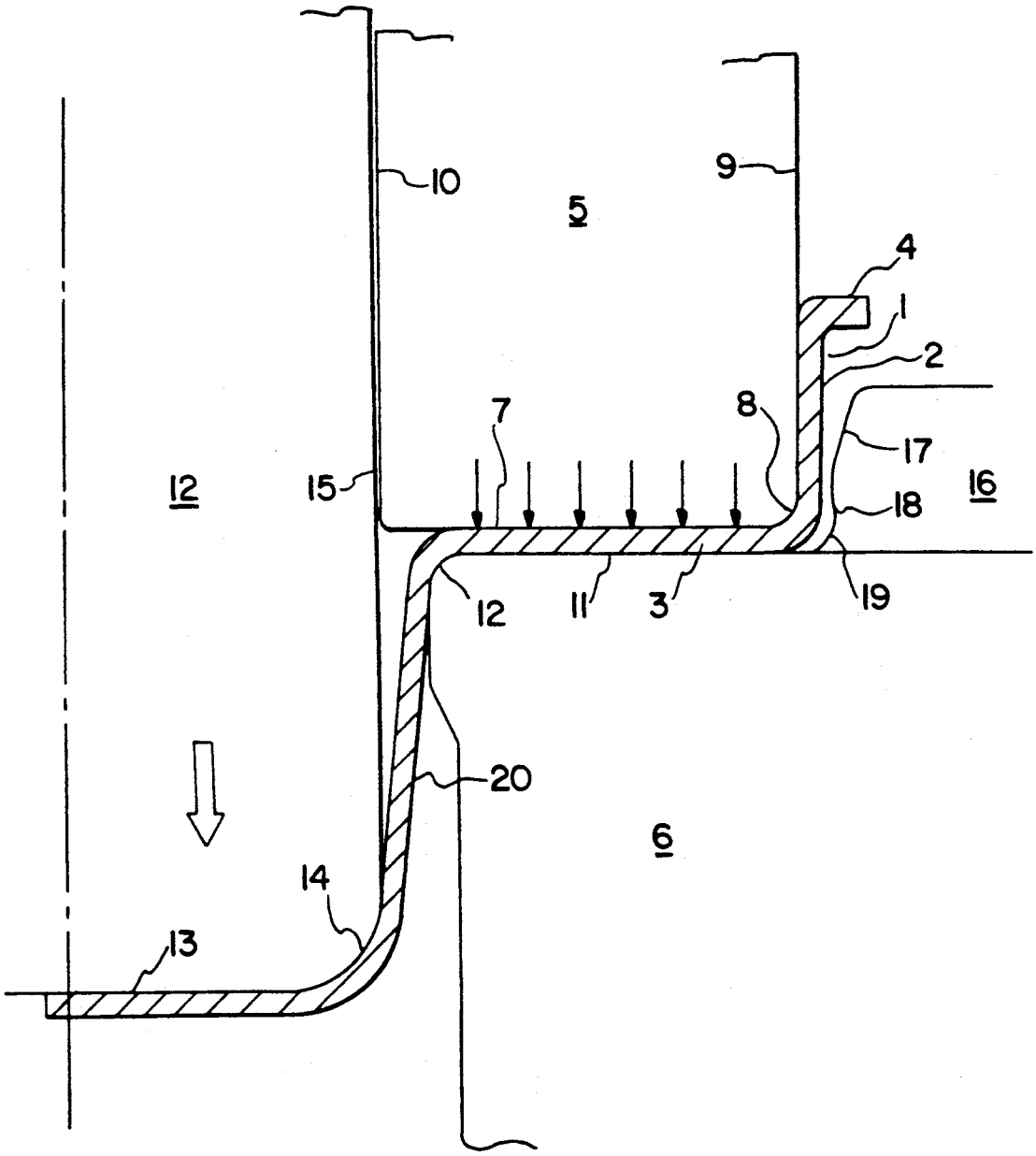

Referring to FIGS. 1 through 3 again, from the state shown in FIG. 1, that is, the state before redrawing, the redrawing punch 12 moves in the direction of arrows as shown in FIG. 2 and redrawing is started. At first, the bottom wall 3 of the preliminarily drawn cup is pressed down by the bottom 13 of the redrawing punch and simultaneously, the side wall 2 of the preliminarily drawn cup is bent vertically inwardly with respect to the radius from the peripheral portion 9 of the blank holder 5 through the corner portion 9, passed through a portion defined by the bottom 7 of the blank holder and the flat portion 11 of the redrawing die and bent substantially vertically to the axial direction by the working corner portion 12 of the redrawing die, whereby a deep-draw-formed cup 20 having a diameter smaller than that of the preliminarily drawn cup 1 is prepared. A back tension necessary for redraw forming is given between the bottom 7 of the blank holder and the flat portion 11 of the redrawing die, and in the case where the curvature radius of the working corner portion 12 of the redrawing die is sufficiently small and the back tension is sufficiently large, the thickness of the side wall is sufficient reduced by bending elongation.

Figure 3:
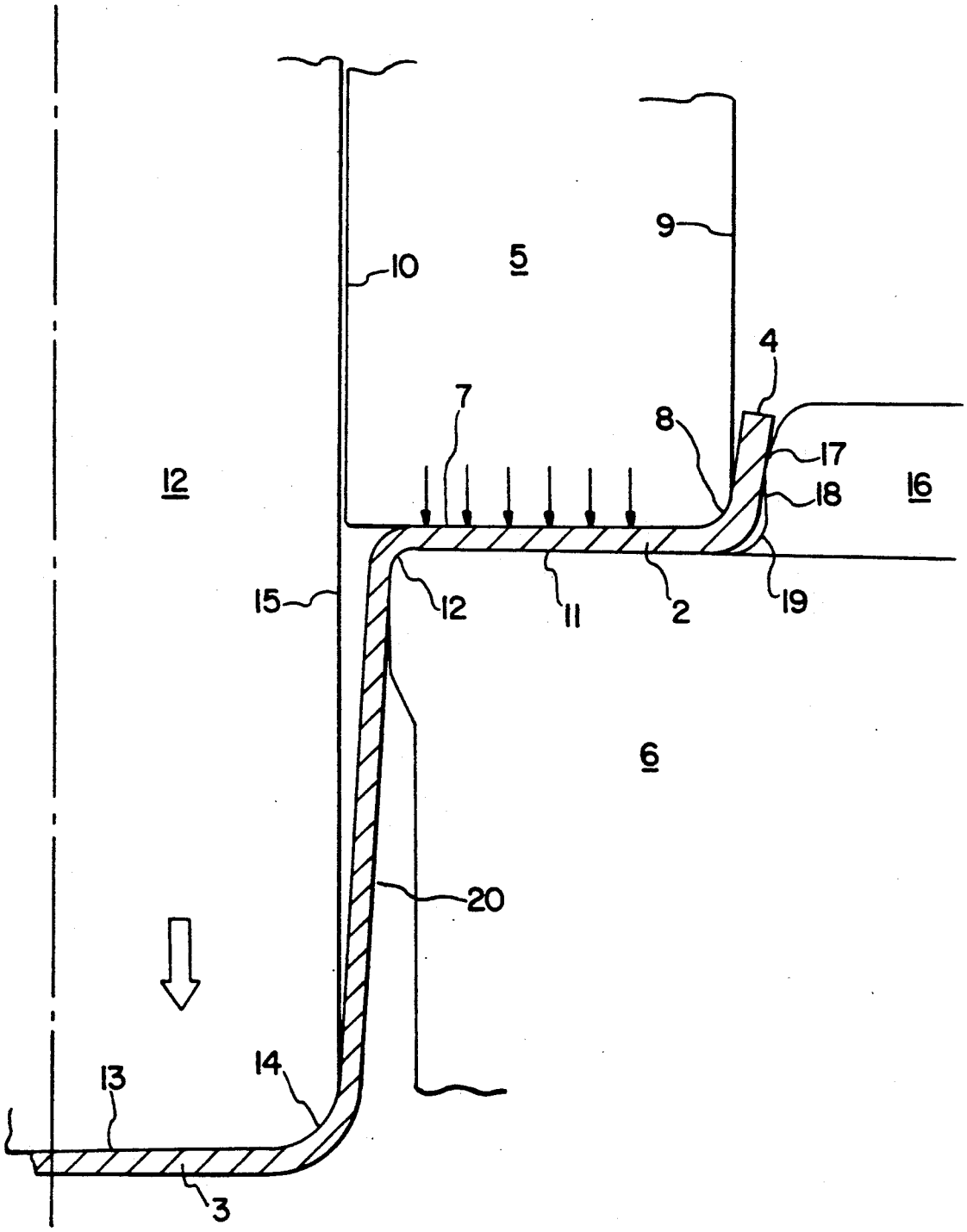

Referring to FIG. 3 illustrating the final stage of the redrawing step, the correction of the residual flange 4 of the preliminarily drawn cup is carried out before this residual flange 4 is introduced between the bottom 7 of the blank holder and the flat portion 11 of the redrawing die. More specifically, the residual flange 4 is pulled downward in the axial direction, while being always contacted with the working face 17 of the flange-correcting die 16 in the tangential direction, whereby the residual flange 4 is corrected and formed into an extension of the side wall 2 of the preliminarily cup 1. Then, the corrected flange portion is introduced between the bottom 7 of the blank holder and the flat portion 11 of the redrawing die and the intended redraw forming is completed.

Figure 5:
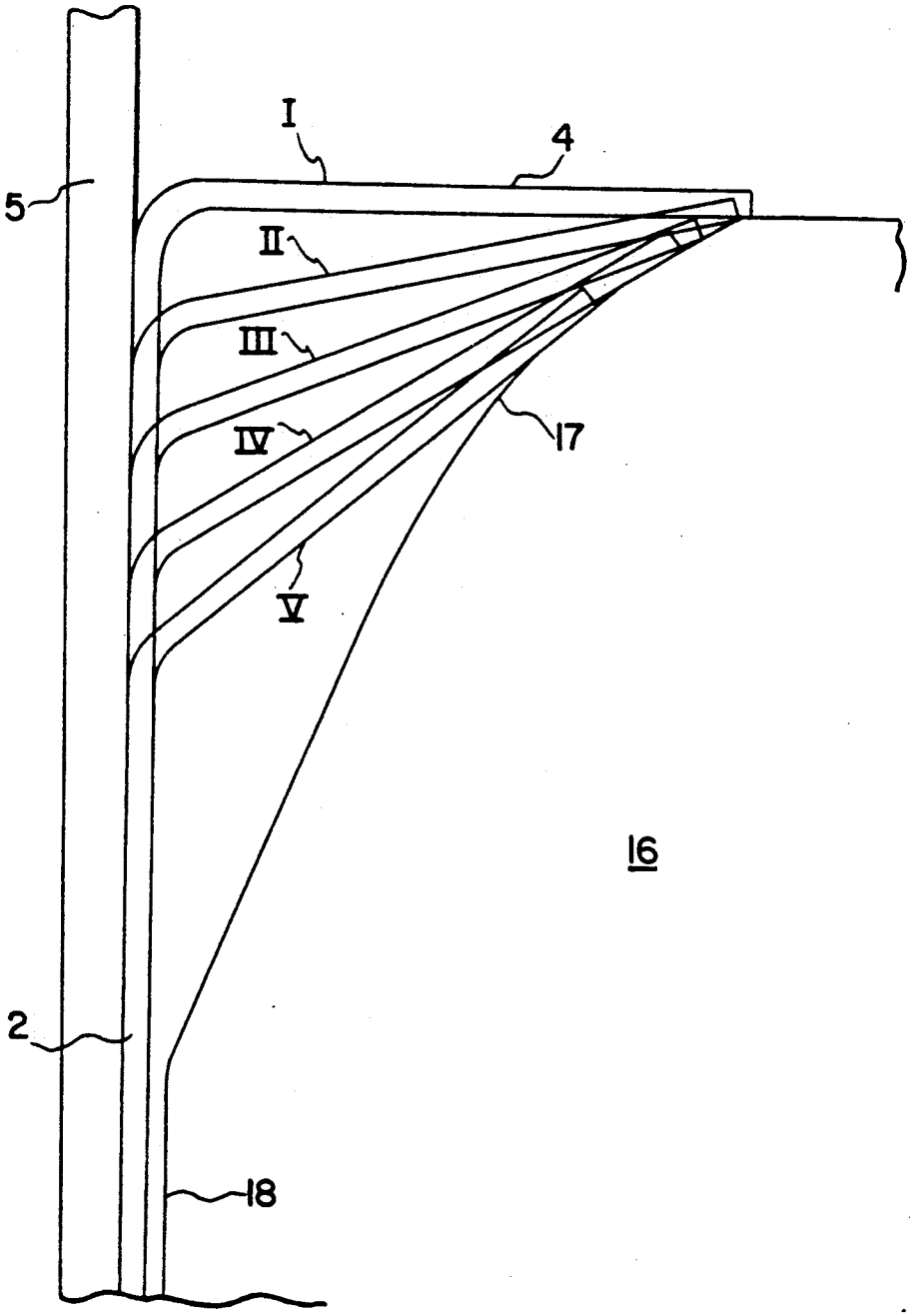
FIG. 5 is a diagram illustrating the order of steps of the operation of correcting the residual flange in the present invention.

Referring to FIG. 5 illustrating the order of this correcting operation of the residual flange 4, the order of the engagement of the flange 4 with the working face 17 of the flange-correcting die 16 is indicated by Roman numerals I, II, III, IV, V, . . . , and it will be understood that the part at the certain position of the flange 4 is always contacted with the working face 17 in the tangential direction.

Figure 6:
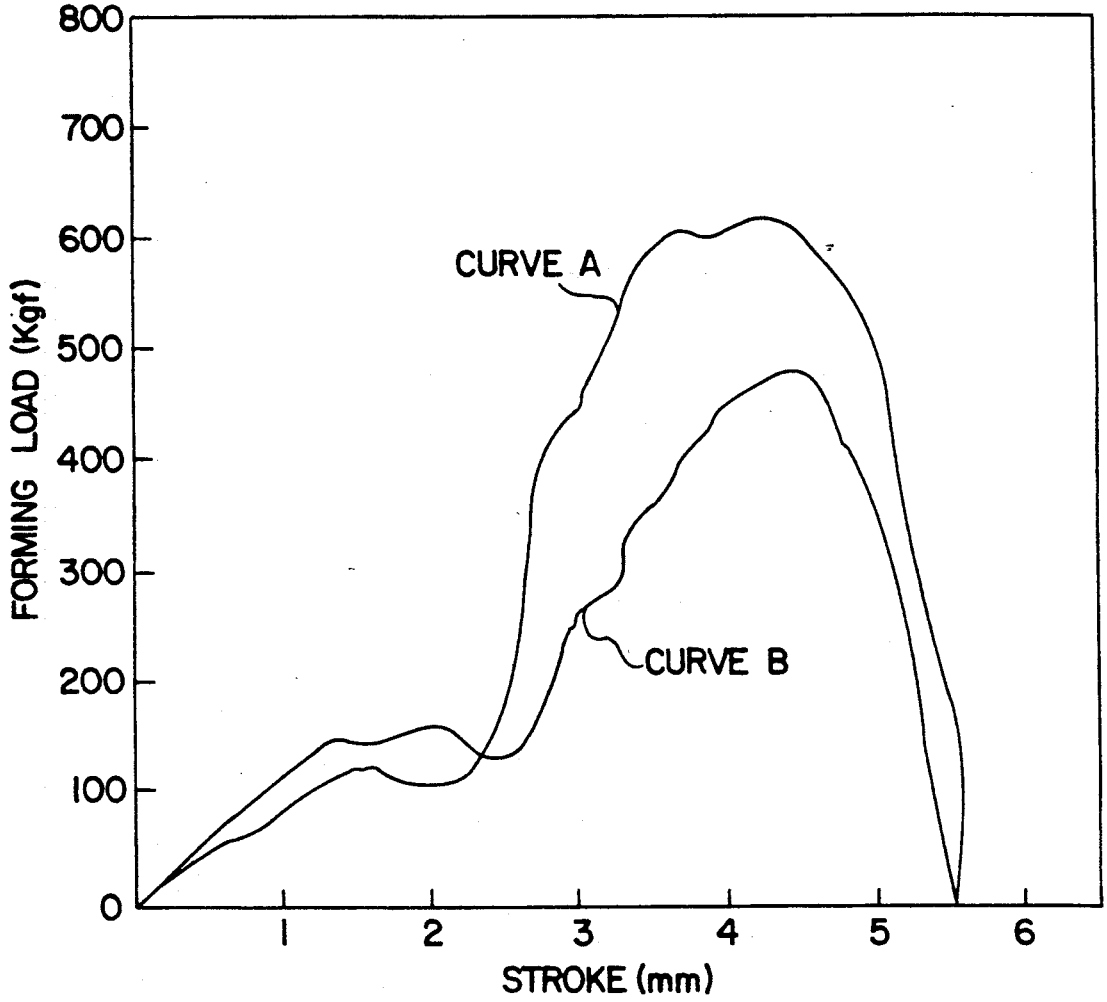
FIG. 6 is a curve showing the relation between the stroke and the forming load, which illustrates the effect by the shape of the flange-correcting die.

FIG. 6 shows the relation between the stroke (abscissa) of the punch and the forming load (ordinate) at the flange-correcting operation, observed when the working face 17 of the flange-correcting die 16 has a tapered shape (curve A) and the working face 17 has a shape of a tractrix (curve B). From the results shown in FIG. 6, it is obvious that according to the present invention, there can be attained an unexpected effect of reducing the highest load at the flange-correcting operation.

In the present invention, various surface-treated steel sheets and sheets of light metals such as aluminum can be used as the metal sheet.

As the surface-treated steel sheet, there can be used steel sheets obtained by annealing a cold-rolled steel sheet, subjecting the annealed steel sheet to the secondary cold rolling and then subjecting the steel sheet to at least one of surface treatments such as zinc plating, tin plating, nickel plating, electrolytic chromate treatment and chromate treatment. As a preferred example of the surface-treated steel sheet, there can be mentioned an electrolytically chromate-treated steel sheet, especially one having 10 to 200 mg/m$^2$ of a metallic chromium layer and 1 to 50 mg/m$^2$ (calculated as metallic chromium) of a chromium oxide layer. This steel sheet is excellent in the combination of the coating adhesion and corrosion resistance. As another example of the surface-treated steel sheet, there can be mentioned a hard tinplate sheet having a tin deposition amount of 0.5 to 11.2 g/m$^2$. Preferably, this tinplate sheet is subjected to the chromate treatment or the chromate/phosphate treatment so that the chromium amount is 1 to 30 mg/m$^2$ as metallic chromium. As still another example, there can be mentioned an aluminum-coated steel sheet formed by deposition or pressure welding of aluminum.

Not only a so-called pure aluminum sheet but also an aluminum alloy sheet can be used as the light metal sheet. An aluminum alloy sheet having a high corrosion resistance and an excellent workability comprises 0.2 to 1.5% by weight of Mn, 0.8 to 5% by weight of Mg, 0.25 to 0.3% by weight of Zn and 0.15 to 0.25% by weight of Cu, the balance being Al. Preferably, these light metal sheets are subjected to the chromate treatment or the chromate/phosphate treatment so that the chromium amount is 20 to 300 mg/m$^2$ as metallic chromium.

The blank thickness ($t_B$) of the metal sheet is changed according to the kind of the metal and the use and size of the final vessel, but it is generally preferred that the blank thickness be 0.10 to 0.50 mm, especially 0.10 to 0.30 mm in case of a surface-treated steel sheet or 0.15 to 0.40 mm in case of a light metal sheet.

Of course, the present invention can be applied to an uncoated metal sheet, but the present invention is advantageous in that if a protecting coating of a resin is formed on a metal sheet prior to draw forming, deep-draw forming and uniform reduction of the thickness can be performed without substantial damage of the protecting covering layer. Formation of the protecting coating can be accomplished by coating a protecting paint or laminating a thermoplastic resin film on the metal sheet.

Protecting paints composed of thermosetting and thermoplastic resins can be optionally used as the protecting paint. For example, there can be mentioned modified epoxy paints such as a phenol-epoxy paint and an amino-epoxy paint, vinyl and modified vinyl paints such as a vinyl chloride/vinyl acetate copolymer paint, a partially saponified vinyl chloride/vinyl acetate copolymer paint, a vinyl chloride/vinyl acetate/maleic anhydride copolymer paint, an epoxy-modified vinyl paint, an epoxyamino modified vinyl paint and an epoxy-phenol-modified vinyl paint, acrylic resin paints, and synthetic rubber paints such as a styrene/butadiene copolymer paint. These paints can be used singly or in the form of mixtures of two or more of them.

A paint as mentioned above is applied to a metal blank in the form of an organic solvent solution such as an enamel or lacquer or in the form of an aqueous dispersion or solution by roller coating, spray coating, dip coating, electrostatic coating or electrophoretic deposition. In case of a thermosetting resin paint, the coated paint is baked according to need. In view of the corrosion resistance and workability, it is preferred that the thickness (in the dry state) of the coaling be 2 to 30 μm, especially 3 to 20 μm. A lubricant can be incorporated in the coating for improving the draw-redraw formability.

As the thermoplastic resin film used for the lamination, there can be mentioned films of olefin resins such as polyethylene, polypropylene, an ethylene/propylene copolymer, an ethylene/vinyl acetate copolymer, an ethylene/acrylic ester copolymer and an ionomer, films of polyesters such as polyethylene terephthalate, polybutylene terephthalate and an ethylene terephthalate/isophthalate copolymer, films of polyamides such as nylon 6, nylon 6,6, nylon 11 and nylon 12, and a polyvinylidene chloride film. These films may be undrawn films or biaxially drawn films. Preferably, the thickness of the thermoplastic resin film is 3 to 50 μm, especially 5 to 40 μm. Lamination of the film on the metal sheet can be accomplished by heat fusion bonding, dry lamination, extrusion coating or the like. In the case where the adhesiveness (heat fusion bondability) between the film and the metal sheet is poor, for example, a urethane type adhesive, an epoxy type adhesive, an acid-modified olefin resin adhesive, a copolyamide type adhesive, a copolyester type adhesive or the like can be interposed between the metal and the metal sheet.

In order to hide the metal sheet or assist the transmission of the blank holding force to the metal sheet at the draw-redraw forming step, an inorganic filler (pigment) can be incorporated into the coating or film used in the present invention.

As the inorganic filler, there can be mentioned inorganic white pigments such as titanium dioxide, zinc flower and gloss white, white extender pigments such as barite, precipitated barite sulfate, calcium carbonate, gypsum, precipitated silica, aerosil, talc, fired or unfired clay, barium carbonate, alumina white, synthetic or natural mica, synthetic calcium silicate and magnesium carbonate, black pigments such as carbon black and magnetite, red pigments such as red iron oxide, yellow pigments such as sienna, and blue pigments such as ultramarine and cobalt blue. The inorganic filler can be incorporated in an amount of 10 to 500% by weight, especially 10 to 300%, based on the resin.

Figure 7:
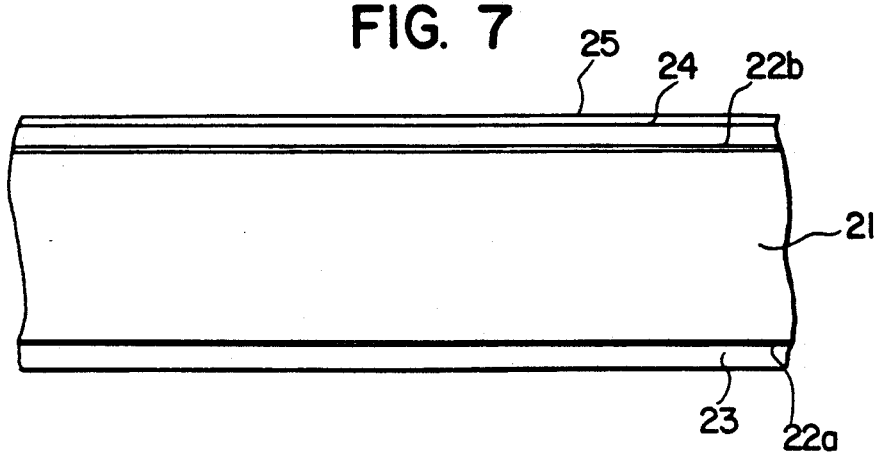
FIG. 7 is a diagram showing an example of the coated metal sheet preferably used in the present invention.
Figure 8A:
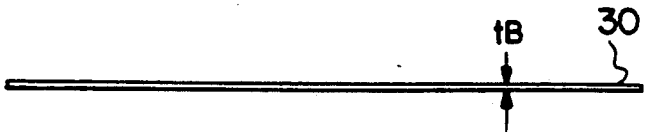
FIGS. 8*a* to *d* illustrate an example of the forming process of the present invention.
Figure 8B:
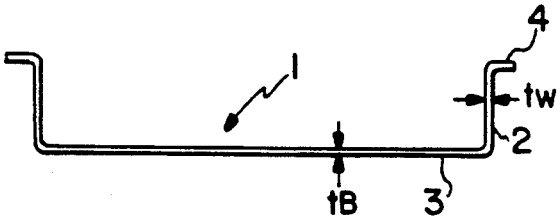
Figure 8C:
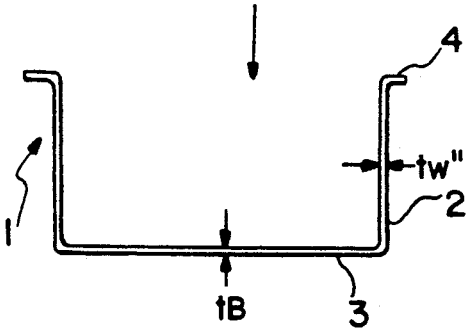
Figure 8D:
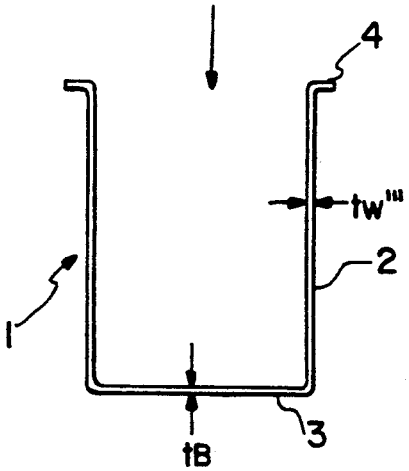
Figure 9A:
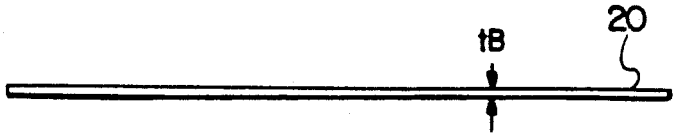
FIGS. 9*a* to *d* illustrate another example of the forming process of the present invention.
Figure 9B:
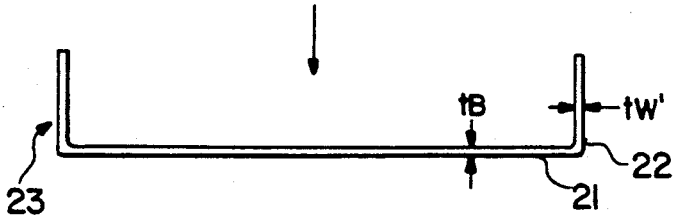
Figure 9C:
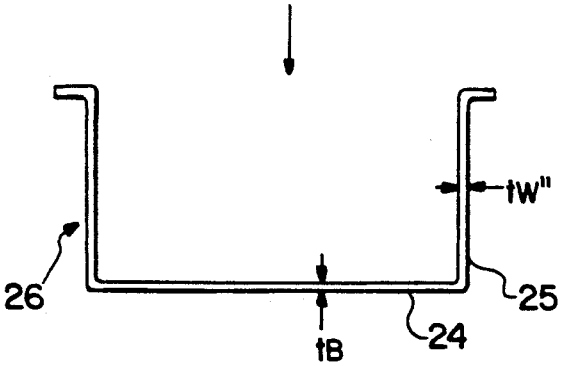
Figure 9D:
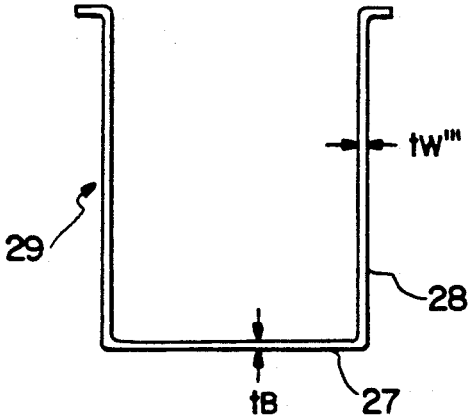

FIG. 7 shows an example of the coated metal sheet preferably used in the present invention. Chemical conversion films 22a and 22b such as chromate-treated films are formed on both the surfaces of a metal substrate 21, and an inner face coating 23 is formed on the surface to be formed into the inner face of the can, through the chemical conversion film 22a. An outer face coating comprising a white coating 24 and a transparent varnish 25 is formed on the surface to be formed into the outer face of the can, through the chemical conversion film 22b.

Referring to FIG. 8 illustrating the forming process of the present invention, a coated metal sheet as mentioned above is punched into a disk 30 having a thickness $t_B$ at the punching step. Then, at the subsequent drawing step, the disk is draw-formed into a preliminarily drawn cup 1 comprising a bottom 3 having a large diameter and a thickness $t_B$, a side wall 2 having a thickness tw' and a low height and a flange 4. At this drawing step, the draw ratio defined by the following formula:

$$\text{draw ratio} = \frac{\text{diameter of blank}}{\text{diameter of drawn can}} \quad (4)$$

is preferably in the range of from 1.2 to 1.9, especially preferably from 1.3 to 1.8. The thickness tw' of the side wall 2 is slightly larger than $t_B$.

Then, at the first redrawing step, the shallowly drawn cup 1 having the residual flange is subjected to redraw forming by an apparatus as shown in FIG. 1, whereby a redrawn cup 1 comprising a bottom 3 having a thickness $t_B$ and a diameter smaller than the shallowly drawn cup, a higher side wall 2 having a thickness tw' and a flange 4 is formed. Similarly, this redrawn cup 1 is subjected to the n-th redrawing forming according to the principle shown in FIGS. 1 through 3.

Another example of the forming process of the present invention is illustrated in FIG. 9. The forming process shown in FIG. 9 is substantially the same as the forming process shown in FIG. 8, but the forming process shown in FIG. 9 is different from the forming process shown in FIG. 8 in that at the drawing step before the redrawing step, a shallowly drawn cup having no flange is formed. Accordingly, in the forming process shown in FIG. 9, at the first redrawing step, a redrawn cup 1 having a flange is formed, and at the subsequent redrawing steps, the redraw forming is carried out according to the principle shown in FIGS. 1 through 3.

According to the present invention, a deep-draw-formed can having an entire draw ratio of from 2.0 to 4.0, especially from 2.0 to 3.5, can be obtained. The width of the residual flange 4 at the preliminary drawing is preferably 1 to 10 mm, especially preferably 1 to 8 mm, and the shape and dimension of the working face are determined according to this width of the flange 4.

It is preferred that the draw forming and redraw forming be carried out after a lubricant has been coated on the coated metal sheet or the preliminarily drawn cup. As the lubricant, there can be used liquid paraffin, synthetic paraffin, edible oil, hydrogenated edible oil, palm oil, natural waxes and polyethylene wax. The amount coated of the lubricant is changed according to the kind of the lubricant, but it is generally preferred that the amount coated of the lubricant be 0.1 to 10 $mg/dm^2$, especially 0.2 to 5 $mg/dm^2$. Coating of the lubricant can be accomplished by spraying the lubricant in the melted state on the surface of the metal sheet or cup.

The draw forming can be carried out at room temperature, but it is preferred that the draw forming be carried out at a temperature of 20° to 95° C. especially 20° to 90° C.

The formed can is formed into a can barrel for a two-piece can through various processings such as flange trimming, doming, necking and flanging.

According to the present invention, by using a flange-correcting die having a specific working face, the residual flange can be corrected and formed into an extension of the side wall of the preliminarily drawn cup under a relatively small forming load, and by feeding the preliminarily drawn cup to the blank holding face between the blank holder and redrawing die in this state, edge breaking of the material, breaking of the coating and formation of a waste thread (enamel air) can be prevented, and a draw-redraw-formed can having excellent shape-manifesting property and dimensional precision can be stably prepared with a good producibility. Moreover, damage and wear of a tool or the like can be controlled.

The present invention will now be described in detail with reference to the following examples.

EXAMPLE 1

An epoxy type thermosetting paint was coated and baked on both the surfaces of a tin-free steel sheet (tempering degree of DR-9) having a blank thickness of 0.18 mm to form a coating having a thickness of 8 μm on each surface, and palm oil was coated and draw forming was carried out to obtain a shallowly drawn cup having a flange. Then, according to the redrawing method of the present invention, redraw forming was carried out. Drawing and redrawing conditions were as described below.

Forming Conditions

A. Draw Forming
- (1) Blank diameter: 187 mm
- (2) Draw ratio: 1.50
- (3) Length of residual flange: 5 mm B. Redraw Forming
- (1) First redraw ratio: 1.29
- (2) Second redraw ratio: 1.24
- (3) Third redraw ratio: 1.20
- (4) Face of working face of flange-correcting die: tractrix
- (5) Distance (a) of from peripheral face of cup to point of contact with working face: 5 mm
- (6) Length of residual flange after redrawing: 5 mm
- (7) Blank holding force: 3000 kgf
- (8) Curvature of working corner portion of redrawing die: 0.5 mm The redraw forming could be performed without edge breaking of the flange portion, breaking of the coating or formation of an enamel hair, and the circularity and the amount of the residual flange were uniform in the redraw-formed cup. When 10,000 cups were continuously processed, the tool was not damaged at all by the correction forming of the flange portion.

EXAMPLE 2

The redraw forming was carried out in the same manner as described in Example 1 except that the shape of the working face of the flange-correcting die was changed to a composite curvature akin to a tractrix (the curvature radius in the introduction portion was 2 mm, the curvature radius of the subsequent portion was 10 mm, and a taper was present between the two portions).

As the result, a good formability comparable to that observed in Example 1 was manifested, and a redraw-formed cup as good as the cup obtained in Example 1 was obtained.

COMPARATIVE EXAMPLE 1

The redraw forming was carried out in the same manner as described in Example 1 except that the shape of the working face of the flange-correcting die was changed to a tapered shape (about 45° ). As the result, wrinkles were formed in the flange portion, the coating was partially peeled and many enamel hairs were formed. In the continuous forming operation, when 2500 to 3000 of cups were processed, streaky build-up of the coating was caused on the flange-correcting die and the surface of the redraw-formed cup was drastically damaged.

COMPARATIVE EXAMPLE 2

The shallowly draw-formed cup having a flange was processed in the same manner as described in Example 1 except that the flange-correcting die was not disposed. When the flange was introduced into the blank holding face at the first redrawing step, many wrinkles were formed in the flange, and at this point, the flange portion was broken and forming became impossible.

EXAMPLE 3

The redraw forming was carried out in the same manner as described in Example 1 except that a polyethylene terephthalate film was bonded as the organic material to each of the surfaces of the metal sheet (the film thickness was 20 μm on each surface).

As the result, a good redraw-formed can was obtained without any damage on the laminated thermoplastic resin film.

EXAMPLE 4

The redraw forming was carried out in the same manner as described in Example 1 except that a shallowly drawn cup having no flange was formed at the drawing step and the obtained cup having no flange was subjected to the redraw forming. The obtained results were as good as those obtained in Example 1.

We claim:

1. A redrawing method for forming a deep-draw-formed cup from a preliminarily shallow-drawn cup with a residual flange, which comprises
   - (i) arranging an annular blank holder to be inserted in the shallow-drawn cup, a redrawing punch which is located coaxially with the blank holder and which is movable within the blank holder, a redrawing die having a diameter larger than that of the redrawing punch but smaller than that of the blank holder and having a flat portion, and a flange-correcting die located coaxially with the blank holder to surround the blank holder with a small distance from the peripheral face of the blank holder and having a working face to be engaged with the flange of the shallow-drawn cup, where the inner diameter of said working face is gradually decreased from the introduction side thereof,
   - (ii) holding the shallow drawn cup by the blank holder and the flat portion of the redrawing die,
   - (iii) relatively moving the redrawing die and the redrawing punch to engage them with each other, thereby draw-forming the shallow-drawn cup into a deep-drawn cup, and
   - (iv) engaging the flange of the shallow-drawn cup with the working face of the flange-correcting die, whereby the flange is corrected and formed into an extension of the side wall face of the shallow-drawn cup, and wherein at least the introduction side portion of the working face has a configuration such that when a tangential line is drawn to the working face, the distance (PQ) from the contact point (P) of the tangential line and the working face to the intersection point (Q) of the tangential line and the peripheral face of the shallow-drawn cup is substantially constant.

2. A redrawing method according to claim 5, wherein the flange-correcting die has a shape substantially of a tractrix.

3. A redrawing method according to claim 1, wherein the distance (PQ) is substantially equal to the width of the residual flange.

4. A redrawing method according to claim 1, wherein a coated metal sheet having a protecting resin coating is used for formation of the preliminarily drawn cup.

* * * * *